United States Patent [19]

Ueda

[11] 4,229,525

[45] Oct. 21, 1980

[54] PROCESS FOR IMPROVING IMAGE-SHARPNESS OF PHOTOGRAPHIC SILVER HALIDE MATERIAL

[75] Inventor: Hirozo Ueda, Minami-ashigara, Japan

[73] Assignee: Fuji Photo Film Co., Ltd., Minami-ashigara, Japan

[21] Appl. No.: 745,893

[22] Filed: Nov. 29, 1976

Related U.S. Application Data

[63] Continuation of Ser. No. 589,995, Jun. 24, 1975, abandoned, which is a continuation-in-part of Ser. No. 346,387, Mar. 30, 1973, abandoned, which is a continuation of Ser. No. 118,488, Feb. 24, 1971, abandoned.

[30] Foreign Application Priority Data

Feb. 24, 1970 [JP] Japan ..... 45/15705

[51] Int. Cl.[3] ..... G03C 1/02

[52] U.S. Cl. ..... 430/568; 430/569; 430/570

[58] Field of Search ..... 96/94 R, 69, 98, 121, 96/19

[56] References Cited

U.S. PATENT DOCUMENTS

| | | | |
|---|---|---|---|
| 3,148,062 | 9/1964 | Whitmore | 96/100 |
| 3,206,313 | 9/1965 | Porter et al. | 96/68 |

FOREIGN PATENT DOCUMENTS

| | | | |
|---|---|---|---|
| 1342687 | 1/1974 | United Kingdom | 96/121 |

*Primary Examiner*—J. Travis Brown
*Assistant Examiner*—Louis Falasco
*Attorney, Agent, or Firm*—Sughrue, Rothwell, Mion, Zinn and Macpeak

[57] ABSTRACT

A photographic silver halide emulsion containing silver halide grains having an average grain size of from 0.3 to 3.0 microns in diameter as a light sensitive element in a dispersing medium and additionally containing super fine grains of silver halide having an average grain size of less than 0.2 microns in diameter is disclosed.

4 Claims, No Drawings

PROCESS FOR IMPROVING IMAGE-SHARPNESS OF PHOTOGRAPHIC SILVER HALIDE MATERIAL

CROSS-REFERENCE TO RELATED APPLICATION

This is a continuation of application Ser. No. 589,995, filed June 24, 1975, now abandoned, which is a Continuation-in-Part application of Ser. No. 346,387, now abandoned filed Mar. 30, 1973 of HIROZO UEDA entitled "Photographic Silver Halide Material"; which in turn is a Continuation application of Ser. No. 118,488 filed Feb. 24, 1971 of HIROZO UEDA entitled "Photographic Silver Halide Material", now abandoned.

BACKGROUND OF THE INVENTION

1. Field of the Invention

This invention relates to a photographic silver halide material, and in particular, a photographic silver halide material having excellent image sharpness.

2. Description of the Prior Art

Ordinary photographic silver halide materials comprise at least one layer of photographic silver halide emulsion having a thickness of several microns coated onto a smooth support having a thickness of about 100 microns made of cellulose triacetate, polyethylene terephthalate, and the like. In this photographic silver halide emulsion layer, a large number of fine crystals of silver halide having a grain size corresponding substantially to the wavelengths of visible rays are dispersed at random in a uniform dispersion medium having a lower refractive index than that of silver halide, for example, in a gelatin layer.

It is well known that when a visible ray for exposure strikes the surface of such photographic silver halide emulsion layer vertically, the ray enters the layer and is scattered by the silver halide grains. This phenomenon is due to the fact that the grain size is approximately the same as the wavelength of the visible ray and the refractive indexes of the grain and the medium are different. This scattering depends on the number of grains per volume in the layer, the grain size, the distribution of the grain size and the difference in the refractive indexes between the grain and the medium. Thus, the incident visible ray in the photographic emulsion layer is scattered therein so as to have components which spread in plain directions parallel to the surface of the emulsion layer even if it is irradiated vertically to the surface of the emulsion layer. Therefore, the image which is obtained through development from the silver halide exposed by this incident ray is blurred. That is to say, the image sharpness decreases. This is markedly noticeable when an image is projected largely to obtain an enlarged print prepared from it. The image detail taken sharply becomes blurred. This depends on the degree of scattering of the incident ray in the emulsion layer, as is apparent from the foregoing description.

Various methods have hitherto been proposed and put into practical use to overcome the disadvantage of the decreases in the image sharpness due to scattering. For example, in one of these methods, the thickness of the photographic emulsion layer is reduced as thin as possible, thereby to suppress the spreading of the scattered rays in the emulsion layer in the plane directions parallel to the surface of the emulsion layer, since the sum of the components in these planar directions, caused by scattering, increases with the increase of the thickness of the photographic emulsion layer. In a multilayer color light-sensitive silver halide material, therefore, it has been proposed to overlay as an uppermost layer a magenta color forming layer, which is most sensitive to human vision.

In another method, a dye capable of absorbing incident rays is added to a photographic emulsion layer to absorb the scattered rays. In this case, even though a large amount of the dye is added, the optical density cannot be raised in the direction of thickness because it is of only several microns in thickness of the photographic emulsion layer, while the path of the ray is so long in the planar directions parallel to the surface of the layer that the components of the scattered rays in these directions may be absorbed effectively.

On the other hand, rays passing while scattering through a photographic emulsion layer and reaching the surface of a support enter into it while being refracted according to the difference in the refractive indexes between the emulsion layer and support, or return to the emulsion layer again while being reflected to the boundary of the emulsion layer and support. At this boundary, however, the rays often are reflected and return into the support because the refractive index of air is smaller than that of the support. When the ray is reflected again into the photographic emulsion layer, the returning position is located relatively distant from the position at which the rays entered the support, because the thickness of the support is ten or more times larger than that of the emulsion layer. That is to say, the rays diffuse markedly in the plane directions parallel to the surface of the emulsion, and the sharpness of an image which is exposed by such ray and developed is deteriorated markedly. In order to prevent the lowering of sharpness causes thereby, it is preferred to dye the boundary between a photographic emulsion layer and support, the support itself, or the boundary between a support and air with an absorber having a suitable absorption wavelength and optical density or coating with a layer dyed therewith.

Moreover, it is also known that blurring of an image after development can be decreased somewhat by an effect known as the development effect during development. Since at the boundary layer of the exposed silver halide grains and the non-exposed grains in a film, a developing agent is fed laterally to the exposed grains whilst the developing reaction product diffuses laterally, the exposed grains in contact with the boundary surface, in particular, are rapidly developed to give a higher density than in the bulk. On the other hand, suppression of the development of the non-exposed grains in contact with the reverse side of the boundary layer often occurs for a similar reason, and thus fog is decreased. Therefore, there takes place a more marked difference of optical density in the narrow zones at the two sides of the boundary layer. Blurring of an image can be reduced by this developing effect.

It is the principal object of the invention to provide a new method by which the above mentioned reason for the deterioration of an image sharpness is eliminated and the image sharpness is thus increased substantially.

The method of this invention is completely different from those of prior arts. Moreover, the image sharpness can be further increased by the combined use of this invention and method of the prior art.

The method of this invention is superior to those of the prior art because it avoids the disadvantages of the latter, for example, decreases in speed and/or gradation.

SUMMARY OF THE INVENTION

This invention is characterized by the random dispersion of a coexistence of super fine crystal grains of silver halide having a much smaller grain size than the wavelength of the visible ray and being substantially transparent to the visible ray in the photographic emulsion layer. That is, it has now been found that the sharpness of a resultant image is markedly raised by the dispersion or the coexistence of silver halide grains having a grain size similar to the wavelength of visible ray, as a main component for forming the image, and the other silver halide grains having a super fine grain size and being substantially transparent to the visible ray in a photographic emulsion layer.

DETAILED DESCRIPTION OF THE INVENTION

Such coexistent super fine grains of silver halide, ordinarily having a very low speed, contribute very little to the formation of an image directly. Accordingly, it is apparent that the main component for forming an image is silver halide grains having a grain size substantially equal to the wavelength of the visible ray. In spite of this, the image sharpness can be raised surprisingly by the coexistence of super fine grains. The reason for this remarkable effect may be understood as follows: The presence of the substantially transparent super fine grains may possibly raise the average refractive index of a dispersing medium in a photographic emulsion layer, for example, gelatin, and thus decrease the difference in the refractive index between the silver halide grains having a grain size substantially equal to the wavelength of visible ray and the medium. The fine grain silver halide may be an efficient absorber of the visible ray. On the other hand, this may be attributed to a developing effect.

It is not known nor practiced to add silver halide super fine grains substantially transparent to an exposing ray to an ordinary photographic silver halide emulsion, that is, comprising silver halide grains having a grain size of about the wavelength of the exposing ray (0.3–3 microns in diameter) dispersed at random in a dispersing medium such as gelatin.

Any silver halide grains which are substantially transparent to the exposing rays may be suitably used for the embodiment of this invention as the super fine grain silver halide. For example, silver iodide, silver iodobromide, silver chloroiodobromide, silver bromide, silver chlorobromide or silver chloride each having a grain size of less than 0.2 micron in diameter is suitable for this purpose. The effect increases with the increase in the amount thereof added to the main photographic emulsion. An addition amount of 10 g or more per 100 g of a dispersing medium in a photographic emulsion, such as an organic hydrocolloid (e.g., gelatin, polyvinyl alcohol, methyl cellulose, agar-agar, gum arabic, and the like), preferably gelatin, is suitable to give the effect but it is desirable not to exceed 50 g since excess addition results in a decrease in speed. This super fine grain silver halide may be subjected to various sensitizing methods as conventional photographic emulsions, for example, to sulfur sensitization, and gold sensitization, and to sensitization using high molecular sensitizers disclosed in U.S. Pat. Nos. 2,716,062, 3,021,215 and 3,062,647, and British Pat. No. 911,501. Any conventional manner in the photographic emulsion industry with advantage may be adapted to the invention. Accordingly to a specific use, the super fine grains are sometimes treated so as to be readily blackened (fogged) or dissolved away during processing. Such super fine grains may only be present during exposure.

On the other hand, any of the conventional photographic silver halide emulsions may be used as an emulsion to which such a super fine grain silver halide is to be added. Preferably, emulsions comprising silver chloride, silver chlorobromide, silver iodide, silver iodobromide or silver chloroiodobromide grains having an average grain size of 0.3–3 microns in diameter and 40–400 g of a dispersing medium such as gelatin per 100 g of silver halide, to which the foregoing various sensitizing methods are applicable, are used.

To the photographic silver halide emulsion of this invention various additives may be added depending upon the specific purposes desired, for example, stabilizers, hardeners, surfactants and pH and pAg regulators. In the case of multi-layer color photographic materials, color couplers may be incorporated. In multi-layer materials, furthermore, the method of the invention, i.e., coexistence of super fine grains of silver halide, may be adapted to any of the photographic layers thereof. Of course, the method of the invention may be adapted to all of the photographic emulsion layers. Furthermore, developing agents and precursors previously may be added to the layers.

The following examples are given in order to illustrate the invention in greater detail without limiting it.

EXAMPLE 1

To 700 g of a negative speed photographic emulsion consisting of 77 g of silver iodobromide grains containing 5 mol% of iodide ion and having an average grain diameter of 0.60 micron, 49 g of gelatin and 574 g of water, was added 300 g of a mixture of an emulsion consisting of 15.6 g of silver iodobromide super fine grains containing 1 mol% of iodide ion and having a grain size diameter of 0.07 micron (maximum 0.10 micron), 15.6 g of gelatin and 268.8 g of water with a 5.2 wt% of an aqueous solution of gelatin, in several mixing ratios (as shown in Table 1), and held at 35.0° C. to give a sol. To the resultant mixture were then added 20 ml of a 0.1% solution of 9-methyl-3,3'-diethyl-5,5'-diethylbenzoselenacarbocyanine bromide in methanol, 60 ml of a 0.1% solution of 3-ethyl-5-methoxy-benzoselena-1'-ethyl-6'-methyl-2'-quinocyanine iodide in methanol, 10 ml of a 0.5 aqueous solution of 5-methyl-7-hydroxy-1,3,4-triazaindolizine, 5 ml of a 2% aqueous solution of mucochloric acid and 2 ml of a 4% aqueous solution of saponin. The resulting photographic emulsion was coated onto a flat support of cellulose triacetate thinly dyed in blue black and having a thickness of 130 microns uniformly to obtain a film thickness of 6.0 microns on a dry basis followed by drying.

Sinusoidal patterns with various spacial frequencies (cf. FUJI PHOTO FILM STUDY REPORT No. 15 (1967), page 36, "Sharpness and Granular Character of Photographic Film" by M. Takano and I. Fujimura) were contacted closely with the photographic emulsion layers having the super fine grain silver halide incorporated in various ratios to the gelatin and printed using a light source having a color temperature of 4,800° K. On the contrary, the photographic films were exposed by the use of an NSG sensitometer for 1/20 second.

The exposed photographic materials were developed at 20° C. for 7 minutes, stopped, fixed, washed with water and dried. Measurement of the optical density of image was carried out by means of a micro-densitometer (Takano et al, supra, page 38) and the response characteristics of spacial frequency were examined to estimate the image sharpness. The results are shown in Table 1.

TABLE 1

| Sample Amount of Super Fine Grain Silver Halide Emulsion * | Amount of 5.2 wt % Aqueous Solution of Gelatin * | Speed | Fog *** | Gamma | Spacial Frequency Response (%) Frequency (L/mm) 5 | 10 | 20 | 30 |
|---|---|---|---|---|---|---|---|---|
| 0 | 300 g | 100 ** | 0.30 | 0.52 | 87 | 78 | 60 | 45 |
| 70 g | 230 g | 100 | 0.29 | 0.51 | 87 | 78 | 62 | 48 |
| 150 g | 150 g | 90 | 0.29 | 0.50 | 92 | 84 | 72 | 58 |
| 300 g | 0 | 80 | 0.28 | 0.49 | 98 | 94 | 81 | 69 |
| 500 g | 0 | 70 | 0.27 | 0.45 | 105 | 100 | 92 | 80 |

*Addition amount per 700 g of the main photographic silver halide emulsion.
**Standard.
***Including opitcal density of support member.

As is evident from these results, the spacial frequency response characteristic is high and the image sharpness is markedly improved with the increase of the amount of super fine grain emulsions added.

EXAMPLE 2

Similar procedures to those of Example 1 were repeated except that the addition amounts of the super fine grain silver halide emulsions and the 5.2 wt % aqueous solution of gelatin were respectively fixed to 150 g per 700 g of the main photographic silver halide emulsion and the grain size of the super fine grain silver iodobromide was varied within a range of 0.05 to 0.3 micron in diameter. The results are shown in Table 2.

TABLE 2

| Sample Average Grain Diameter of Super Fine Grain Silver Iodobromide (μ) | Speed | Fog* | Gamma | Spacial Frequency Response (%) Frequency (L/mm) 5 | 10 | 20 | 30 |
|---|---|---|---|---|---|---|---|
| Without Super Fine Grains | 100** | 0.30 | 0.55 | 87 | 78 | 60 | 45 |
| 0.07 | 95 | 0.29 | 0.50 | 95 | 90 | 80 | 65 |
| 0.12 | 70 | 0.30 | 0.50 | 90 | 85 | 75 | 70 |
| 0.18 | 64 | 0.31 | 0.50 | 95 | 88 | 72 | 60 |
| 0.27 | 50 | 0.30 | 0.35 | 90 | 82 | 68 | 50 |

*Including optical density of support
**Standard.

As is evident from these results, the image sharpness is markedly improved when the grain size is 0.2 micron or less.

EXAMPLE 3

Similar procedures to those of Example 2 were repeated except that the halide was changed to the chloride, the bromide and the bromoiodide, while holding the average grain size of the super fine grain silver halide near 0.15 micron in diameter. The results are shown in Table 3.

TABLE 3

| Sample Halogen of Super Fine Grain Silver Halide | Speed | Fog* | Gamma | Spacial Frequency Response (%) Frequency (L/mm) 5 | 10 | 20 | 30 |
|---|---|---|---|---|---|---|---|
| Silver Iodobromide | | | | | | | |

TABLE 3-continued

| Sample Halogen of Super Fine Grain Silver Halide | Speed | Fog* | Gamma | Spacial Frequency Response (%) Frequency (L/mm) 5 | 10 | 20 | 30 |
|---|---|---|---|---|---|---|---|
| (1 mol % iodine) | 68 | 0.31 | 0.50 | 95 | 88 | 72 | 70 |
| Silver Bromide | 80 | 0.33 | 0.47 | 90 | 85 | 70 | 60 |
| Silver Chloride | 90 | 0.31 | 0.52 | 103 | 90 | 78 | 65 |
| Without Super Fine Grains | 100** | 0.30 | 0.55 | 87 | 78 | 60 | 45 |

*Including optical density of support.
**Standard.

As is evident from these results, the super fine grain emulsions gave an excellent effect in increasing the image sharpness.

EXAMPLE 4

This example illustrates the case of a multi-layer color photographic material.

To 700 g of a negative sensitivity photographic emulsion consisting of 77 g of silver iodobromide grains containing 5 mol % of iodide ion and having an average grain size of 0.60 micron in diameter, 49 g of gelatin and 574 g water, as an emulsion for red sensitive layer, was added 300 g of a 5. 2 wt % aqueous solution of gelatin (Sample 1) or 300 g of an emulsion consisting of 15.6 g of silver iodobromide super fine grains containing 1 mol % of iodide ion and having a grain size of 0.07 micron in diameter, 15.6 g of gelatin and 268.8 g of water (Sample 2), followed by holding respectively at 35.0° C. to obtain a sol. To each of the resultant mixed emulsions were added, in order, 80 ml of a 0.05% solution of anhydro-9-ethyl-3,3'-(2-hydroxy-1-sulfopropyl)-naphthothiacarbocyanine hydroxide in methanol, 40 ml of a 0.5 aqueous solution of 5-methyl-7-hydroxy-1,3,4-triazaindolizine and a coupler emulsified dispersion obtained by dissolving with heating 1 g of N-n-dodecyl-1-hydroxy-2-naphthoic acid amide, as a cyan coupler in 1 ml of dibutyl phthalate and 2 ml of ethyl acetate and then emulsifying and dispersing the solution in 10 g of a 10 wt % aqueous solution of gelatin in the presence of 1.2 ml of a 5% aqueous solution of sodium dodecyl sulfate so as to add 0.2 g of coupler/mol of silver halide, and further the hardener of Example 1 and a surfactant.

These two kinds of red-sensitive layer emulsions were coated onto anti-halation layer-coated supports cellulose triacetate so as to give a film thickness of 4.0 microns on dry base, followed by coating thereon a thin gelatin layer.

To 800 g of the same silver iodobromide emulsion as the above described emulsion for a red-sensitive layer (average grain size: 0.60 micron in diameter) was added 200 g of a 5.2 wt % aqueous solution of gelatin (Sample 1) or 200 g of the above mentioned super fine grain silver iodobromide emulsion (average grain size=0.07 micron in diameter) (Sample 2), and held at 35.° C. to give a sol. To each of the resultant emulsions were added, in order, 80 ml of a 0.1% solution of anhydro-3,3'-disulfopropyl-9-ethyl-5,5'-diphenyloxacarbocyanine hydroxide in methanol, 40 ml of a 0.5% aqueous solution of 5-methyl-7-hydroxy-1,3,4-triazaindolizine and a coupler emulsified dispersion obtained by dissolving with heating 1.5 g of 1-(2,4,6-trichloro)-phenyl-3-dodecylamide-5-pyrazolone, as a magenta coupler, in 1.5 ml of tricresyl phosphate and 2 ml of ethyl acetate and then emulsifying and dispersing the solution in 10 g of a 10 wt % aqueous solution of gelatin in the presence of 1.2 ml of a 5% aqueous solution of sodium dodecyl sulfate to give a proportion of 0.23 g coupler/mol silver halide. These two kinds of emulsions for a green-sensitive layer were respectively coated onto the Samples 1 and 2 of the red-sensitive layer in such a manner that the Samples 1 and 2 of the green-sensitive layer were placed on the foregoing gelatin layer. The film thickness of the green-sensitive layer was 4.5 microns on a dry basis. Furthermore, a yellow colloidal silver-gelatin layer containing colloidal silver grains of an average grain size of 0.03 micron was coated thereon uniformly to give a thickness of 1.0 micron on a dry basis. Then, to 850 g of the same emulsion (average grain size: 0.60 micron) as that for the green-sensitive layer, as an emulsion for blue-sensitive layer, was added 150 g of a 5.2 wt% aqueous solution of gelatin (Sample 1) or 150 g of the above-mentioned super fine grain emulsion (average grain size: 0.07 micron) (Sample 2), and held at 35.0° C. to give a sol. To each of the resultant emulsions were added, in order, 40 ml of a 0.5% aqueous solution of 5-methyl-7-hydroxy-1,3,4-triazaindolidine and a coupler emulsified dispersion obtained by dissolving with heating 1.5 g of 4-dodecyl-benzoyl-2-methoxy-acetanilide, as a yellow coupler, in 2.0 ml of dibutyl phthalate and 1.5 ml of ethyl acetate and then emulsifying and dispersing the solution in 10 g of a 10 wt % aqueous solution of gelatin in the presence of 1.2 ml of a 5% aqueous solution of sodium dodecyl sulfate to give a proportion of 0.22 g coupler/mol silver halide. These two kinds of emulsions for a blue-sensitive layer were respectively coated to give a film thickness of 5.0 microns on a dry basis in such a manner that the blue-sensitive emulsion of Sample 1 was placed on the green-sensitive layer of Sample 1 through the foregoing yellow colloidal silver gelatin layer and similarly the blue-sensitive emulsion of Sample 2 on the green-sensitive layer of Sample 2. Finally, a uniform gelatin layer was coated thereon thinly to obtain a protective layer. Thus, two color photographic materials of the comparative sample 1 free from the super fine grain silver halide and the test sample 2 containing the same were obtained. These light-sensitive materials were exposed in the same manner as in Example 1 through a sinusoidal pattern or conventional wedge to a light source having a color temperature of 3200° K. and developed at 24° C. for 10 minutes with the following developer.

| Developer Composition | |
|---|---|
| Water | 800 ml |
| N-Methyl-p-aminophenol | 4.5 g |
| Hydroquinone | 5.5 g |
| Anhydrous Sodium Sulfite | 50 g |
| Sodium Carbonate (monohydrate) | 30.5 g |
| Potassium Bromide | 1.5 g |
| 0.1% Aqueous Potassium Iodide Solution | 10 ml |
| Potassium Thiocyanate (10% aqueous solution) | 20 ml |
| Water to | 1000 ml |

After being washed with water, the entire surface of the film was uniformly irradiated with a strong white light and processed at 24° C. for 15 minutes with the following color developer.

| Color Developer Composition | |
|---|---|
| Water | 800 ml |
| Benzyl Alcohol | 5.0 ml |
| Anhydrous Sodium Sulfite | 5.0 g |
| Trisodium Phosphate (12-hydrate) | 40 g |
| Sodium Hydroxide | 1.5 g |
| Potassium Bromide | 0.5 g |
| Ethylenediamine | 5.0 ml |
| Citrazinic acid | 1.5 g |
| p-Amino-N-ethyl-N-β-methane-sulfonamidoethyl-m-toluidine Sulfate | 10.5 g |
| Water to | 1000 ml |

The films were then subjected to water washing, bleaching, fixing and water washing, thus obtaining color positive images. The optical density was measured to obtain the characteristics as shown in Table 4.

TABLE 4

| Sample | Speed | | | Gamma | | | Spacial Frequency Response (%) Frequency (L/mm) | | | |
|---|---|---|---|---|---|---|---|---|---|---|
| | Red | Green | Blue | Red | Green | Blue | 5 | 10 | 20 | 30 |
| 1. Comparison | 100* | 100 | 100 | 2.1 | 2.0 | 2.2 | 110 | 80 | 37 | 20 |
| 2. Test, containing super fine grains | 82 | 88 | 95 | 1.9 | 1.9 | 2.1 | 110 | 92 | 50 | 28 |

*Standard.

As is evident from this table, the special frequency characteristics are markedly improved while the sensitivity is held substantially unchanged.

EXAMPLE 5

To 1 kg of the super fine grain silver iodobromide emulsion of Example 3 and 1 kg of the sample for comparison, not containing the same, was added 30 ml of a 2% aqueous solution of the potassium salt of bis-(3-methyl-1-(4-sulfophenyl)-pyrazole-5-on)trimethineoxonol and coated. The films were exposed and developed in the similar manner to those of Examples 1–3 and the spacial frequency response characters were examined. The exposure was carried out using a non-metallic interference filter having a transmission maximum at 546 mm so that only the light to be absorbed by the added magenta dye entered the sample. The results are shown in Table 5.

TABLE 5

| Sample (Containing Magenta Dye) | Speed* | Fog** | Gamma | Spacial Frequency Response (%) Frequency (L/mm) 5 | 10 | 20 | 30 |
|---|---|---|---|---|---|---|---|
| Without Super Fine Grains | 80 | 0.30 | 0.51 | 90 | 82 | 65 | 50 |
| Containing Silver Iodobromide Super Fine Grains | 53 | 0.30 | 0.46 | 102 | 94 | 73 | 65 |

*Speed for the sample free from both dye and fine grain is put as 100.
**Including optical density of support member.

As is evident from comparison of this table with Table 3, the spacial frequency characteristics are increased by dyeing the emulsion layer with a magenta dye. According to this invention, however, the speed loss is less than that with the dyeing method at the same level of improvement in frequency response. It is also shown in this table that the combination of the methods according to this invention and that of a prior art (dyeing) gives additive improvement.

What is claimed is:

1. A process for improving image-sharpness of a photosensitive material comprising a support having thereon at least one layer containing a negative working photographic emulsion containing randomly dispersed light-sensitive silver halide grains having an average grain size of from 0.3 to 3.0 microns in diameter, as the main silver halide image-yielding component thereof in a photographically compatible dispersing medium, which process comprises incorporating at random in said emulsion prior to adding any sensitizing dye to said emulsion super-fine grains of silver halide having an average grain size of less than 0.2 microns in diameter in said emulsion in an amount of from 10 g to 50 g per 100 g of said dispersing medium, said super-fine grains of silver halide co-existing with said light-sensitive silver halide grains and being substantially transparent to visible rays and contributing very little to the formation of an image directly, whereby said emulsion exhibits increased image sharpness without a significant decrease in speed and/or gradation.

2. The process of claim 1, wherein a sensitizing dye is added to said photographic emulsion after said super-fine grains of silver halide are incorporated in the emulsion.

3. The process of claim 1, wherein the dispersing medium is gelatin.

4. The process of claim 3, wherein said prepared photographic silver halide emulsion is free from spectral sensitizing dye.

* * * * *